United States Patent [19]

Aoki et al.

[11] Patent Number: 5,072,878

[45] Date of Patent: Dec. 17, 1991

[54] AIR CONDITIONING APPARATUS

[75] Inventors: Katsuyuki Aoki; Hideaki Nagatomo; Seiji Kubo; Hiroyuki Umemura; Toshihiro Tanaka; Kazuaki Isono; Hidenori Ishioka, all of Shizuoka, Japan

[73] Assignee: Mitsubishi Denki Kabushiki Kaisha, Tokyo, Japan

[21] Appl. No.: 497,698

[22] Filed: Mar. 23, 1990

[30] Foreign Application Priority Data

Jul. 31, 1989 [JP] Japan ..... 1-89918[U]

[51] Int. Cl.[5] ..... F24F 11/04

[52] U.S. Cl. ..... 236/38; 236/49.3; 454/258; 454/313

[58] Field of Search ..... 62/186; 236/49.3, 38; 98/38.5, 38.6, 40.25, 40.24

[56] References Cited

U.S. PATENT DOCUMENTS 4,615,481 10/1986 Tanaami et al. ..... 236/38

FOREIGN PATENT DOCUMENTS 2,769,371 4/1971 Australia .
1,456,170 5/1970 Australia .
4,327,172 12/1973 Australia .
7,299,974 3/1976 Australia .
2,175,283 6/1984 Australia .
831,443 4/1944 Australia .
4,242,272 11/1973 Australia .
7,017,774 12/1975 Australia .
5,255,886 8/1986 Australia .
7,716,375 7/1976 Australia .
0153128 9/1982 Japan ..... 98/40.24
0144554 7/1985 Japan ..... 98/40.25
61-54150 11/1986 Japan .
62-10543 1/1987 Japan .
62-10547 1/1987 Japan .
0194152 8/1987 Japan ..... 62/186

*Primary Examiner*—William E. Wayner
*Attorney, Agent, or Firm*—Oblon, Spivak, McClelland, Maier & Neustadt

[57] ABSTRACT

An air conditioning apparatus comprises a plurality of outlet ports, a blowing fan for blowing off an conditioned air from the outlet ports to the outside of the main body of the apparatus, an air directing plate arranged in at least one of the outlet ports to enable the direction of the conditioned air to change, an operation state detecting device for detecting the operation state of the main body, and a driving device for adjusting the position of the air directing plate, depending on signals from the operation state detecting device.

12 Claims, 9 Drawing Sheets

AIR CONDITIONING APPARATUS

BACKGROUND OF THE INVENTION

The present invention relates to an air conditioning apparatus and is more particularly concerned with an air conditioning apparatus which is capable of blowing off a conditioned air in a suitable manner, depending on the temperature condition in the room to be air-conditioned.

FIGS. 10 through 13 show a conventional air conditioning apparatus which is disclosed in e.g. Japanese Examined Patent Publication No. 54150/1986. In FIGS. 10 through 13, reference numeral 1 designates the main body of an indoor unit where a heat exchanger 2 and an impeller 3 of a blowing fan are housed. Reference numeral 4 designates an intake port which is formed in an upper portion of the front panel of the main body 1 to be opposite to the heat exchanger 2. Reference numeral 5 designates a lower outlet port which is formed in the bottom panel of the main body 1 to blow off downward the conditioned air which is inspired through the intake port 4 by the fan 3 and is heat exchanged in the heat exchanger 2. Reference numeral 6 designates a horizontal outlet port which is formed in a lower part of the front panel of the main body 1 to blow off in the horizontal direction the conditioned air which is inspired through the intake port 4 by the fan 3 and is heat exchanged in the heat exchanger 2. Reference numeral 7 designates a blowing air guiding wall which is arranged between the lower outlet port 5 and the horizontal outlet port 6, and which comprises a lower wall extending in a downward direction and a horizontal wall extending in the horizontal direction to be of a dogleg shape in section. Reference numeral 8 designates blowing air volume controlling plate which is carried on a horizontal shaft 9. The horizontal shaft 9 is supported by the main body to be capable of swinging about the apex of the blowing air guiding wall. Reference numeral 10 designates a step motor which swings the horizontal shaft 9. Reference numerals 11 and 12 designate a first limit switch and a second limit switch which function to limit the swinging range of the blowing air volume controlling plate 8, and which detect the swinging positions of the plate 8 and reverse the rotation of the step motor 10.

Now, the operation of the air conditioning apparatus as constructed in such manner will be explained. When a power switch is closed, the heat exchanger 2 and the fan start to work, the air in the room is inspired through the intake port 4 by the fan, and the conditioned air which has been heat exchanged in the heat exchanger 2 is blown off through the lower and horizontal outlet ports 5 and 6 in the lower and horizontal directions at the distribution rate which is determined depending on the swinging position of the blowing air volume controlling plate 8. At the same time when the power switch is closed, the blowing air volume controlling plate 8 starts to be swung between the first and second limit switches 11 and 12 through the horizontal shaft 9 by the step motor 10. The swinging motion of the blowing air volume controlling plate 8 makes the air volume blown off from the lower and horizontal outlet ports 5 and 6 change with time. The changing state of the blowing air volume is shown in FIG. 14. In FIG. 14, a dotted line a indicates the air volume which is blown off from the lower outlet port 5, a solid line b indicates the air volume which is blown off from the horizontal outlet port 6, an alternate long and short dash line c indicates the total amount of the air volume from both outlet ports 5 and 6, and a solid line d indicates the temperature of the blowing conditioned air. At the time $T_1$ in FIG. 14, the air condition in the room takes a state as shown in FIG. 15. In this state, the blowing air volume of the horizontally blowing air 14 is large, and the blowing air volume of the downwardly blowing air 15 is small. In addition, the temperature of the blowing conditioned air is not high, and the difference between the temperature of the blowing air and the temperature in the room is small. In this way, a great agitating effect can be obtained. Although a part of the downwardly blowing air 15 rises toward the ceiling 13*a*, the rising part is caught in the horizontally blowing air 14 to be prevented from reaching the ceiling. As a result, a hot air can be prevented from staying adjacent to the ceiling 13*a*, and heat loss to the outside of the room is minimized. In addition, the horizontally blowing air 14 can agitate the air in the room to minimize the deterioration in the temperature distribution in the room. The air condition in the room at the time $T_2$ in FIG. 14 takes a state as shown in FIG. 16. In this state, the blowing air volume of the horizontally blowing air 14 is small, and the blowing air volume of the downwardly blowing air 15 is large. As a result, the downwardly blowing air 15 can reach the floor 13*b* to give a great agitating effect to the air in the room, thereby obtaining the temperature distribution in the room in a good manner. Although the horizontally blowing air 14 tries to slightly rise, the downwardly blowing air 15 agitates the horizontally blowing air 14 at a position adjacent to the ceiling 13*a*, preventing the horizontally blowing air 14 from staying at such position.

Because the conventional air conditioning apparatus cyclically changes the distribution ratio of the horizontally blowing air 14 and the downwardly blowing air 15 particularly in room heating, the conventional apparatus has a problem in that when the apparatus starts to work or the apparatus has a great heating load, sufficient heat can not reach the floor 13*b* requiring a great quantity of heat to increase the temperature on the floor 13*b* at once, making a user feel cold.

SUMMARY OF THE INVENTION

It is an object of the present invention to solve the problem and to provide an air conditioning apparatus capable of sufficiently heating the floor at the time of starting room heating operation or having a great heating load, and producing the temperature distribution in the room in a comfortable manner at the time of having a relatively small heating load.

The foregoing and other objects of the present invention have been attained by providing an air conditioning apparatus comprising a plurality of outlet ports, a blowing fan for blowing off an conditioned air from the outlet ports to the outside of the main body of the apparatus, an air directing plate arranged in at least one of the outlet ports to enable the direction of the conditioned air to change, an operation state detecting means for detecting the operation state of the main body, and a driving means for adjusting the position of the air directing plate, depending on signals from the operation state detecting means.

As a result, the air conditioning apparatus according to the present invention can change the flowing direction of the conditioned air from at least one of the outlet ports to obtain a desired air flow distribution in the room.

When the operation state detecting means is a temperature state detecting means for detecting the temperature state of the main body, the apparatus can control the air flow distribution in the room depending on an air conditioning load (air temperature).

When the operation state detecting means is a timer for counting the time which has passed since the operation of the main body had started, the apparatus can control the air flow distribution in the room depending on the time which has passed since the operation of the main body had started.

When the air directing plate is placed in a horizontal outlet port, the apparatus can control the air flow distribution in the room depending on the flowing direction of the conditioned air from the horizontal outlet port.

When the air directing plates are placed in the horizontal outlet port, and a lower outlet port, respectively, the apparatus can control the air flow distribution in the room depending on the flowing directions of the conditioned air from the horizontal outlet port and the lower outlet port.

PREFERRED EMBODIMENTS

Figure 1:
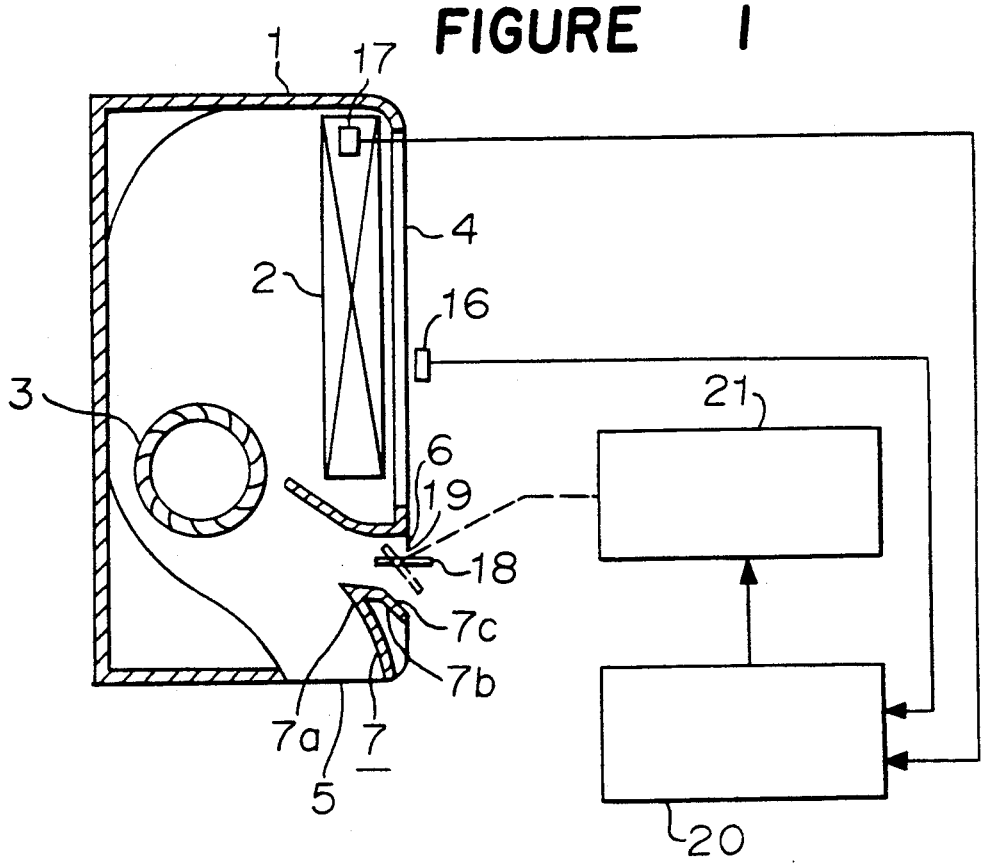
FIG. 1 is a cross sectional view showing a first embodiment of the apparatus according to the present invention.
Figure 2:
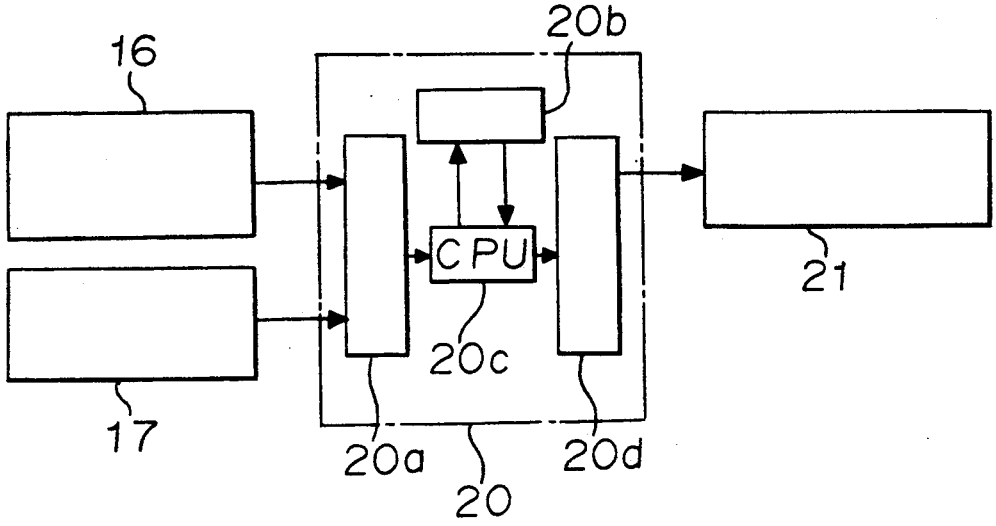
FIG. 2 is a block diagram showing an air directing plate control means in the first embodiment.
Figure 3:
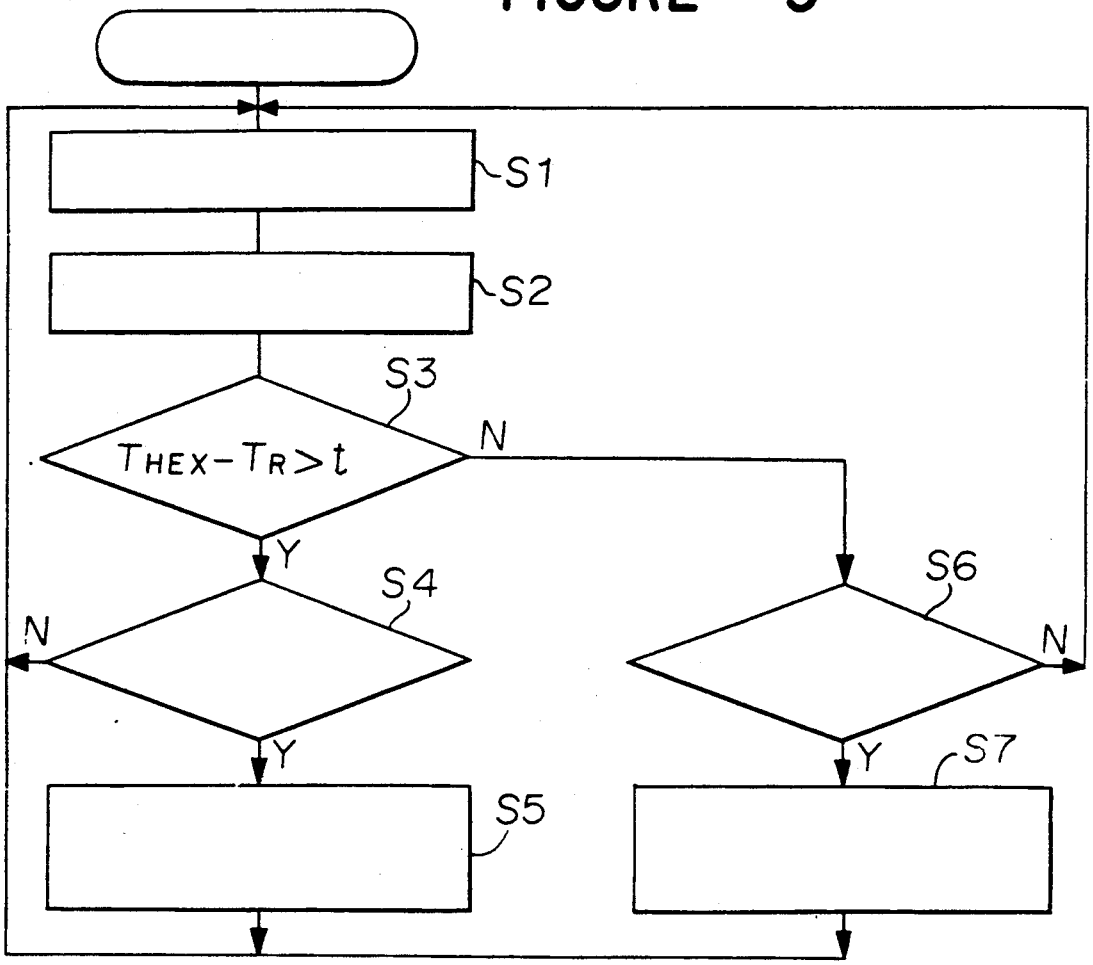
FIG. 3 is a flow chart showing the process which is carried out in the air directing plate control means.

Now, the present invention will be described in detail with reference to preferred embodiments illustrated in the accompanying drawings.

Firstly, a first embodiment of the air conditioning apparatus according to the present invention will be explained in detail with reference to FIGS. 1 through 4.

Reference numeral 7 designates a blowing air guiding wall which is arranged between a first outlet port 5 and a second outlet port 6. The first outlet port 5 is formed at the bottom panel of an indoor unit main body 1 to blow off conditioned air downwardly. The second outlet port 6 is formed in the front panel of the main body to blow off conditioned air in the horizontal direction. The blowing air guiding wall has a downward wall *7a* extending downwardly (in the first direction) toward the first outlet port 5, a horizontal wall *7b* extending horizontally (in the second direction) toward the second outlet port 6, and a side wall *7c* extending in the first direction. The horizontal wall *7b* is continuous with the downward wall *7a* and the side wall *7c*. The blowing air guiding wall is of a dogleg shape in section. Reference numeral 16 designates a room temperature detector which is arranged in an intake port 4 formed in the front panel of the main body to detect the temperature in the room to be air conditioned. Reference numeral 17 designates a heat exchanger temperature detector which is provided on an indoor heat exchanger 2 to detect the temperature of the heat exchanger 2. The room temperature detector 16 and the heat exchanger temperature detector 17 constitute a temperature state detecting means. Reference numeral 18 designates a second air directing plate which is mounted to the second outlet port 6 through a second horizontal shaft 19 swingingly supported by the second outlet port to control the blowing direction of the conditioned air. The second air directing plate takes two positions, i.e. the horizontal position and the position in parallel with the side wall *7c* of the blowing air guiding wall 7. Reference numeral 21 designates an air directing plate driving electric motor which is constituted by a step motor to swing the horizontal shaft 19. Reference numeral 20 designate an air directing plate control means which receives detection signals from the room temperature detector 16 and the heat exchanger temperature detector 17, and which drives the second air directing plate driving electric motor 21 so that the air directing plate 18 changes the blowing direction of the conditioned air from the second direction to the first direction and from the first direction to the second direction depending on the detection signals. The air directing plate control means is constituted by a micro computer. The micro computer comprises an input unit 20*a* to which detection signals are inputted from the room temperature detector 16 and the heat exchanger temperature detector 17, a memory unit 20*b* which stores a processing program for driving the air directing plate 18, the difference between a set temperature difference and other data, a CPU 20*c* which carries out arithmetic manipulation, e.g. receives the detection signals from the room temperature detector 16 and the heat exchanger temperature detector 17 through the input unit 20*a* and compares the difference between the detected temperatures by both detectors 16 and 17 with a set room temperature difference stored in the memory unit 20*b* in accordance with the program stored in the memory unit 20*b*, and which outputs the results of the arithmetic manipulation, and an output unit 20*d* which transfers the results of the arithmetic manipulation from the CPU 20*c* to the air directing plate driving electric motor 21. The air directing plate control means is associated with the air directing plate driving electric motor 21 to constitute a driving means which can swing the air directing plate 18 so that the blowing direction of the conditioned air from the second outlet port is changed from the second direction to the first direction, and from the first direction to the second direction depending on the detection signals from the room temperature detector 16 and the heat exchanger temperature detector 17.

Reference numeral 3 designates a blowing fan impeller which is arranged in the main body to feed the conditioned air to the first outlet port and the second outlet port.

Figure 4:
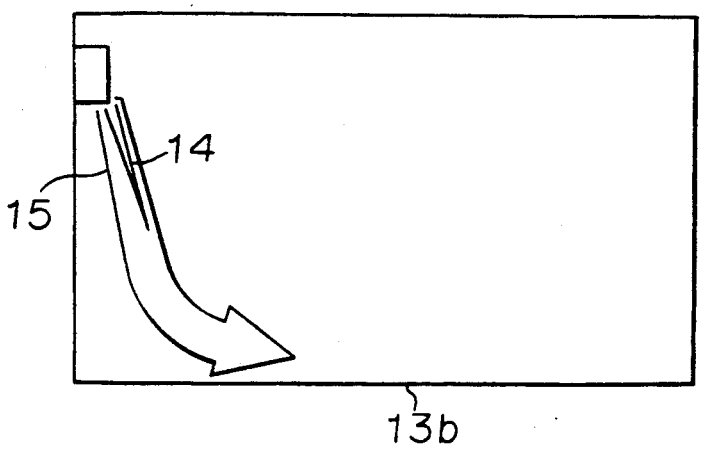
FIG. 4 is a diagram showing the flow of the flowing air.
Figure 5:
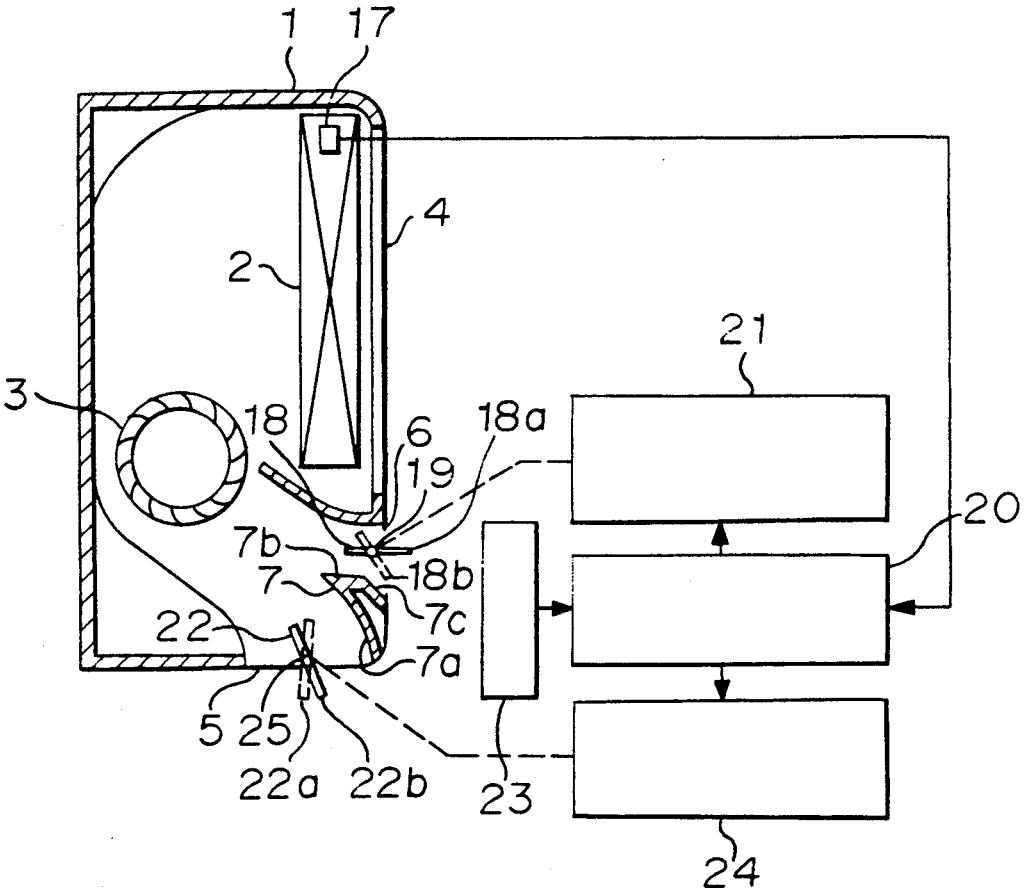
FIG. 5 is a cross sectional view showing a second embodiment.
Figure 16:
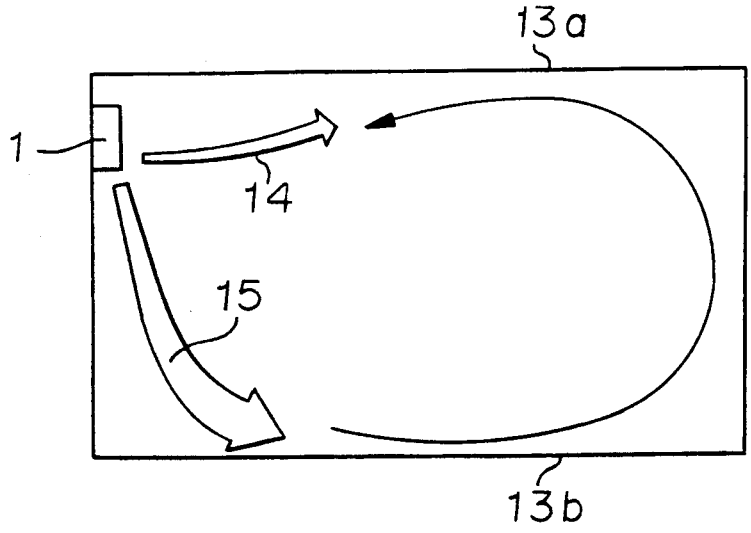

The operation of the air conditioning apparatus having the structure described above will be explained with reference to FIG. 3 which shows the processing flow at the time of room heating. When a power switch is closed, the indoor heat exchanger 2 and the fan 3 start to work. The conditioned air which has been inspired through the intake port 4 by the fan and is heat exchanged in the heat exchanger 2 is blown off from the first outlet port 5 and the second outlet port 6. At this time, the air directing plate control means 20 operates to carry out the processing flow shown in FIG. 3. Specifically, at a step S1 the air directing plate control means 20 receives from the room temperature detector 16 a detection signal corresponding to an actually room temperature $T_R$. At a step S2, the air directing plate control means 20 receives from the heat exchanger temperature detector 17 a detection signal corresponding to a heat exchanger temperature $T_{HEX}$. The heat exchanger 2 is incorporated into a volume control type air conditioning apparatus wherein the greater load is, the greater the capacity becomes, and wherein the fan is driven at the same air volume. As a result, the heat exchanger temperature $T_{HEX}$ is higher than the actual room temperature $T_R$, and the greater the load is, the higher the heat exchanger temperature $T_{HEX}$ becomes. At a step S3, the difference between the detection signal from the room temperature detector 16 and the detection signal from the heat exchanger temperature detector 17 is calculated, and the result of this calculation is compared to a set temperature difference which is stored in the memory unit 20*b*. Because the result of the calculation is greater than the set temperature difference at the time of starting the room heating or of having a great load, the process proceeds to a step S4, where it is judged whether the air directing plate 18 is in the horizontal position or not. When it is in the horizontal position, the air directing plate driving electric motor 21 is driven to move the air directing plate 18 into the downwardly slanted position. As a result, the conditioned air which has been inspired through the intake port 4 by the fan and is heat exchanged in the heat exchanger 2 is blown off downwardly from the first outlet port 5 and the second outlet port 6, i.e., in the form of blowing airs 14 and 15 toward the first direction as shown in FIG. 4. In this way, the blowing air 15 from the first outlet port 5 and the blowing air 14 from the second outlet port 6 join together and reach the floor 13*b* of the room, allowing the floor 13*b* to be sufficiently heated at the time of starting the room heating or at the case wherein an external temperature is low and loss in the quantity of heat from the floor 13*b* is great, and accordingly allowing a user to feel warm at once. Such process is continued in the circulation of the steps S1-S2-S3-S4-S1-. When the difference between the heat exchanger temperature $T_{HEX}$ and the room temperature $T_R$ achieves not higher than the set temperature difference, the process proceeds from the step S3 to a step S6, where it is judged whether the air directing plate 18 is the downward position or not. When the air directing plate 18 is in the downward position, the process proceeds to a step S7. At the step S7, the air directing plate driving electric motor 21 is driven to move the air directing plate 18 into the horizontal position. At this position, the blowing air 15 from the first outlet port 5 is blown off downwardly, i.e., in the first direction, whereas the blowing air 14 from the second outlet port 6 is blown off horizontally, i.e., in the second direction. In this way, the flow state of the conditioned air is the same as that shown in FIG. 16.

The decrease in the blowing air in the downward direction, and the presence of the blowing air in the horizontal direction provide a good agitating effect in the room, and prevent warm air from staying adjacent to the ceiling 13*a* of the room, allowing a good temperature distribution to be obtained in the room, and a comfortable air condition to be established in the room. Such process is repeated in the circulation of the steps S1-S2-S3-S6-S1- until the room heating load becomes great and the temperature difference between the temperatures detected by both detectors 16 and 17 achieves to not lower than the set temperature difference.

Although in the first embodiment the swing control of the air directing plate 18 is carried out based the result of the comparision of the temperature difference between the temperatures detected by both detectors 16 and 17 to the set temperature difference, the heat exchanger temperature detector 17 can be eliminated, and a target set temperature for the room temperature can be stored in the memory unit 20*b*. The target set temperature is compared to the temperature detected by the room temperature detector 16, and the air directing plate 18 is controlled based on the result of the comparision.

In the first embodiment, a blowing air volume control plate which is carried on a horizontal shaft rotatably supported along the apex of the blowing air guiding wall 7 can be provided like the conventional air conditioning apparatus shown in FIGS. 10 through 13. When the temperature difference detected by the detectors is not higher than the set temperature difference, the blowing air volume control plate is controlled like the conventional apparatus.

Next, a second embodiment of the air conditioning apparatus according to the present invention will be described in detail with reference to FIGS. 5 through 9.

In FIGS. 5 through 9, reference numeral 22 designates a first air directing plate which controls the blowing direction of the conditioned air, and which is carried on a first horizontal shaft 25 rotatably supported by the first outlet port 5 so that the first air directing plate can be set in the perpendicular position 22*a* directed to just below the main body 1 and the position 22*b* directed to a slant direction. The second air directing plate 18 which controls the blowing direction of the conditioned air is arranged in the second outlet port 6 through the second horizontal shaft 19 rotatably supported in the second outlet port 6, like the first embodiment. The second air directing plate 18 can be set two positions, i.e., the position 18*a* directing to the horizontal direction and the slant position 18*b* in parallel with the side wall 7*c* of the blowing air guiding wall 7. Reference numeral 24 designates a first air directing plate driving electric motor which is constituted by a step motor for rotating the first horizontal shaft 25. Reference numeral 21 designates a second air directing plate driving electric motor which is constituted by a step motor for rotating the second horizontal shaft, like the first embodiment. Reference numeral 23 designates a timer which counts the time which has passed since the commencement of room heating. There is provided an air directing plate control means 20 which controls the first air directing plate driving electric motor 24 and the second air directing plate driving electric motor 21, and to which a detection signal from the heat exchanger temperature detector 17, and a timer count signal from the timer 23 are inputted as input signals.

The operation of the second embodiment will be explained.

Figure 6:
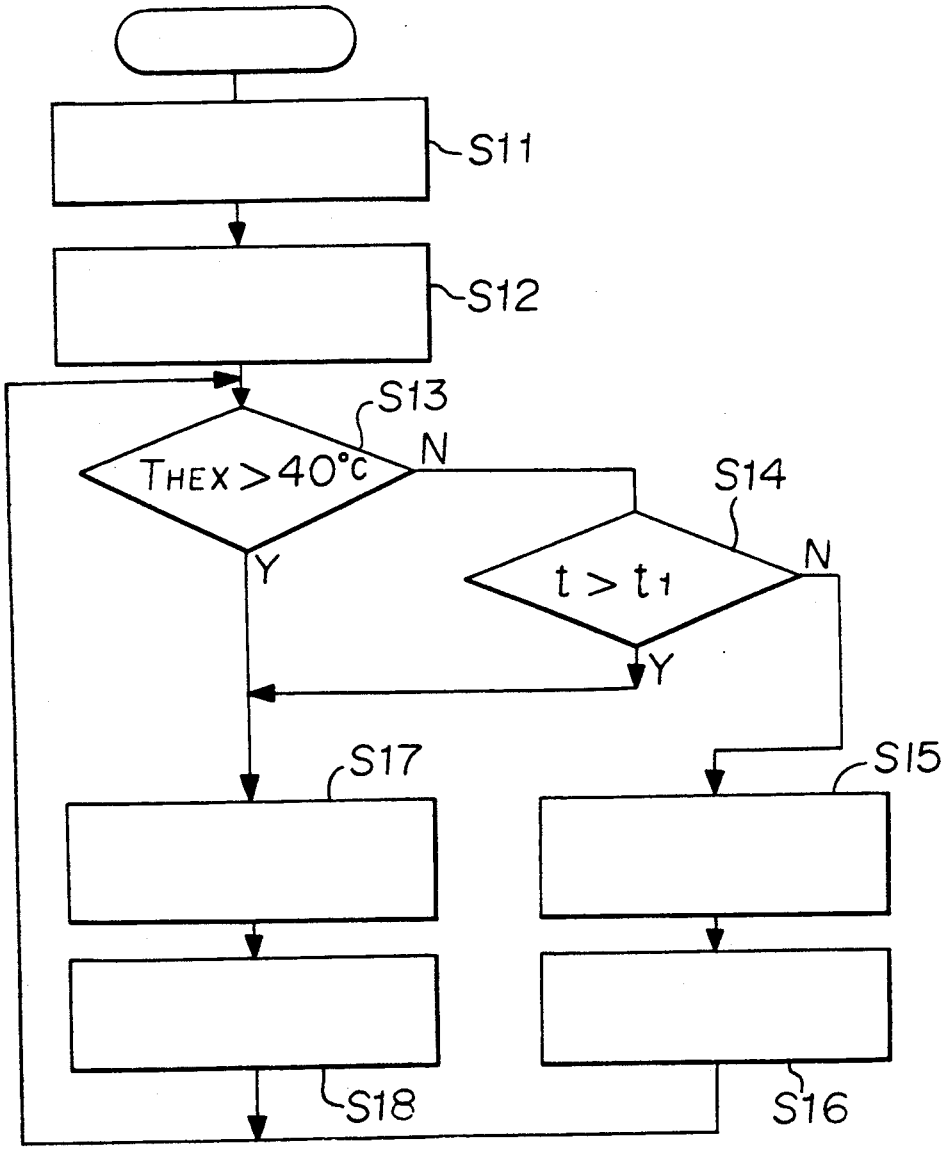
FIG. 6 is a flow chart showing the control which is carried out in the second embodiment.
Figure 7:
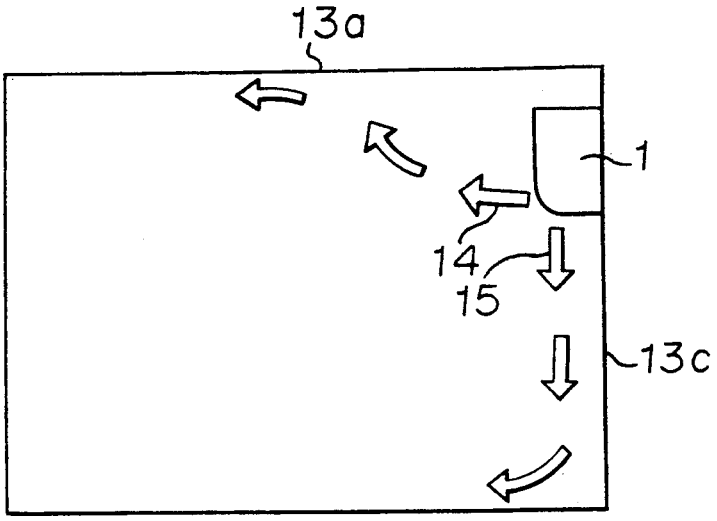
FIG. 7 is a schematic diagram showing the flow of the blowing air which is obtained at the time of the starting the operation; 15
Figure 8:
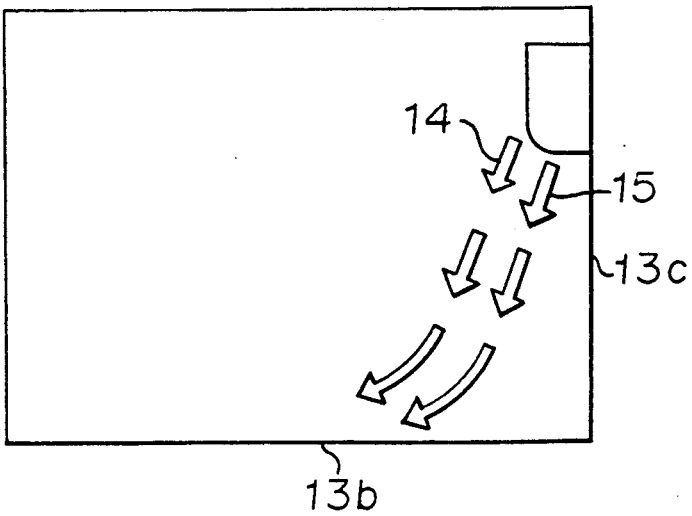
FIG. 8 is a schematic diagram showing the flow of the blowing air which is obtained when a predetermined operation time has passed or the actual room temperature is above a set room temperature.

FIG. 6 is a control flow chart of the second embodiment of the air conditioning apparatus according to the present invention, and the operation on room heating will be described in detail with reference FIG. 6.

When the power switch is closed, the heat exchanger 2 and the fan 3 start to work. The conditioned air which has been inspired through the intake port 4 by the fan 3 and is heat exchanged in the heat exchanger 2 is blown out off from the first outlet port 5 and the second outlet port 6.

At this time, the air directing plate control means starts to work, and timer count begins at a step S11. At a step S12, the air directing plate control means receives from the heat exchanger temperature detector 17 a direction signal corresponding to a heat exchanger temperature $T_{HEX}$.

At the beginning of the commencement of operation, the temperature of the heat exchanger is low because the temperature of inspired air is low. Accordingly, the temperature of blowing air is also low. In consideration of this fact, the heat exchanger temperature $T_{HEX}$ is compared to a set heat exchanger temperature (e.g. 40° C.) at a step S13. When the heat exchanger temperature $T_{HEX}$ achieves to not higher than the set temperature (e.g. 40° C.), the process proceeds to a step S14. At the step S14, the time t counted by the timer 23 is compared to a set time $t_1$. When the time t which has passed since room heating operation started is not longer than the set time $t_1$, the process proceeds to a step S15. At the step S15, the first air directing plate driving motor 24 is driven to move the first air directing plate 22 to the perpendicular position 22*a*. Then, the second air directing plate driving motor 21 is driven to move the second air directing plate 18 to the horizontal position 18*a* at a step S16. As a result, the conditioned air which has been inspired through the intake port 4 by the fan 3 and is heat exchanged in the heat exchanger 2 is blown out off the first outlet port 5 in the perpendicular direction along the wall surface 13*c* extending to just below the main unit 1, and the second outlet port 6 in the horizontal direction along the ceiling 13*a*.

In this way, during the time between the commencement of the room heating operation and the lapse of the set time $t_1$, the blowing air 15 from the first outlet port 5 heats the wall surface 13*c* extending to just below the main unit 1, and the blowing air 14 from the second outlet port 6 heats the ceiling 13*a*, minimizing coldness caused by cold radiation, and allowing a user to feel warm.

Such state is repeated in the circulation of the steps S13-S14-S15-S16-S13-. When the heat exchanger temperature $T_{HEX}$ exceeds the set temperature (40° C.), or when the time t which has passed since the room heating operation started exceeds the set time $t_1$, the process proceeds to a step S17 where the first air directing plate driving motor 24 is driven to move the first air directing plate 22 to the slant position 22*b*. Then, at a step S18, the second air directing plate driving motor 21 is driven to move the second air directing plate 18 to the slant position 18*b*.

At this state, the blowing air 15 from the first outlet port 5 is blown out off in the slant direction, i.e. toward the floor 13*b*, and the blowing air 14 from the second outlet port 6 is also blown out off in the slant direction, i.e. toward the floor 13*b*. In this way, the flow state shown in FIG. 8 can be established.

As a result, an increase in the temperature of the floor can be rapidly accelerated, allowing the user to sufficiently feel warm. Such state is repeated in the circulation of the steps S13-S14-S17-S18, or the steps S13-S17-S18.

Figure 9:
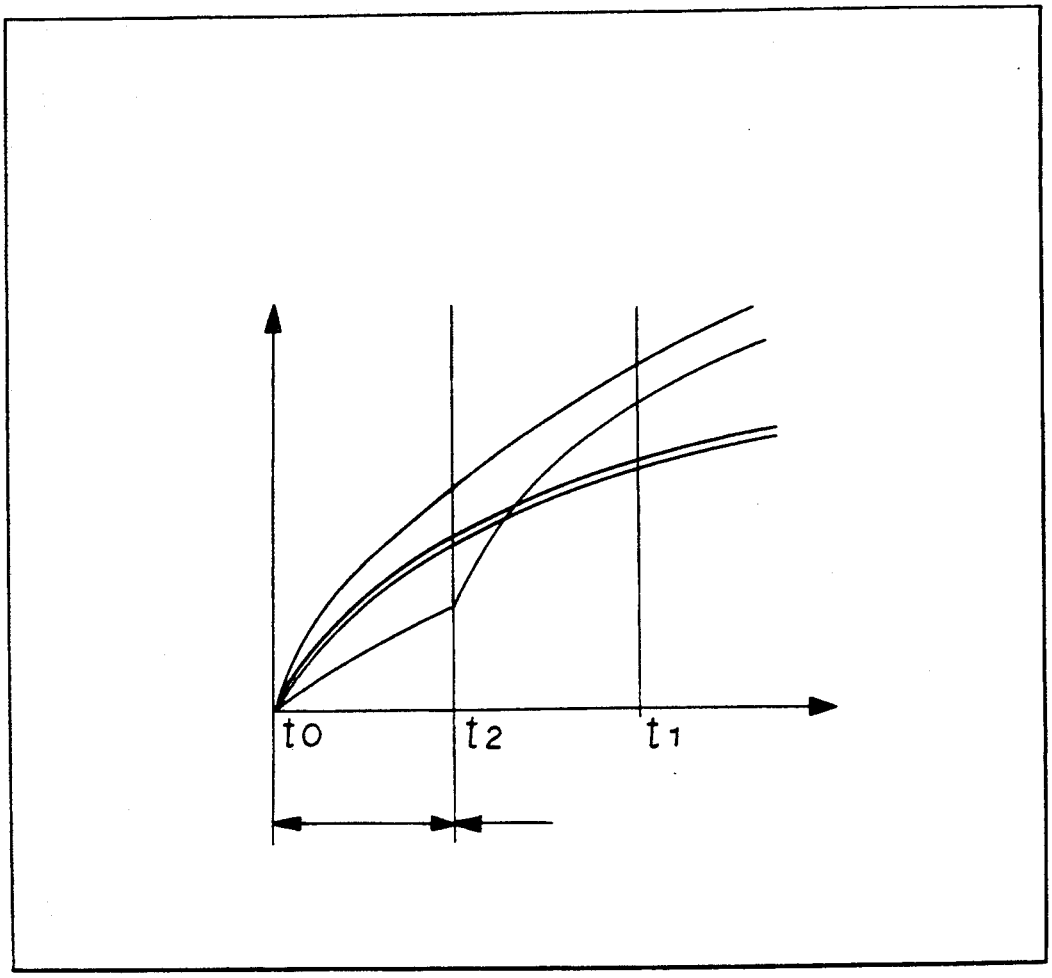
FIG. 9 is a graph showing temperature characteristics on room heating.
Figure 10:
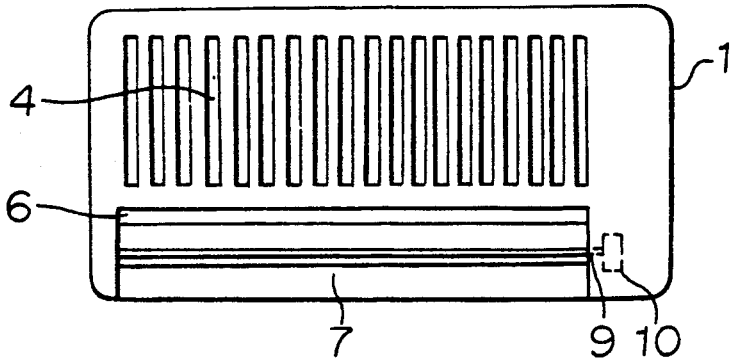
FIG. 10 is a front view showing the conventional air conditioning apparatus.
Figure 11:
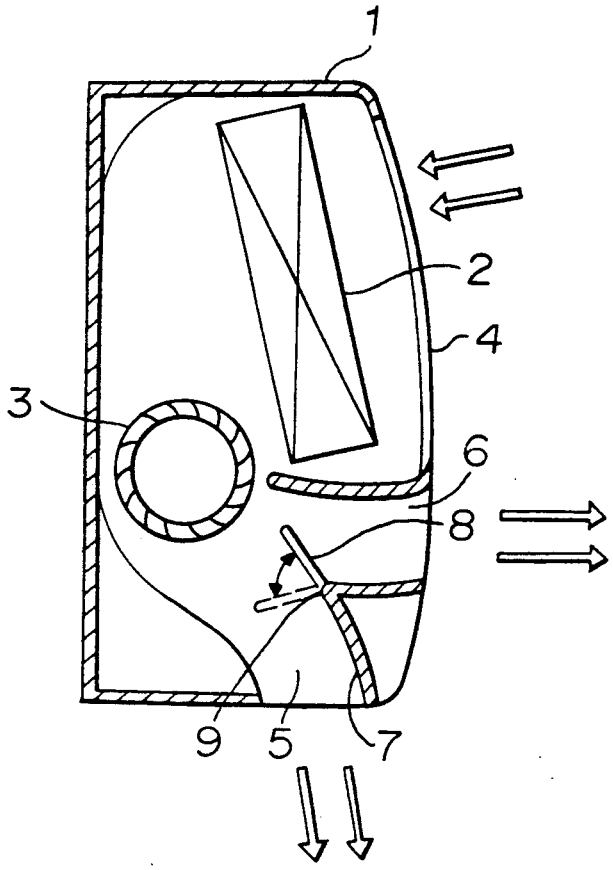
FIG. 11 is a cross sectional view of the conventional apparatus.
Figure 12:
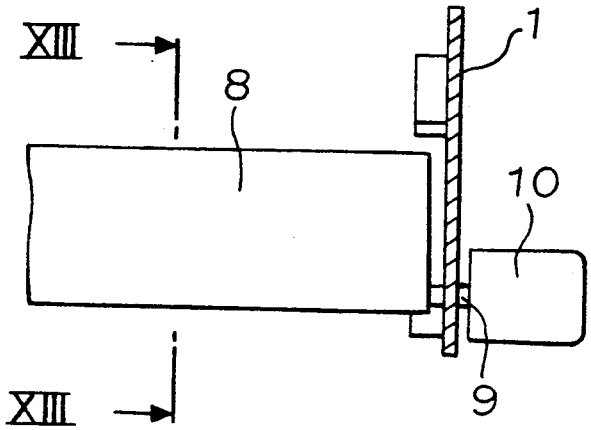
FIG. 12 is a partially cutaway view of the conventional apparatus.
Figure 13:
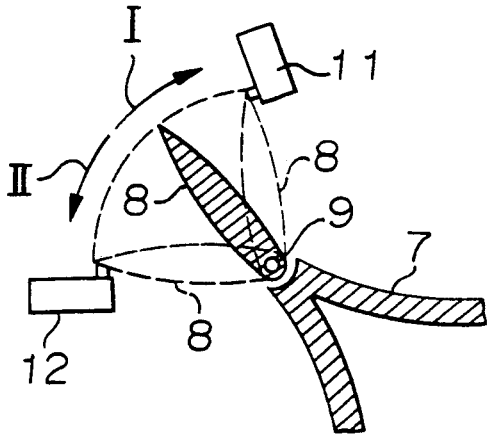
FIG. 13 is a cross sectional view taken along line XIII—XIII of FIG. 12.
Figure 14:
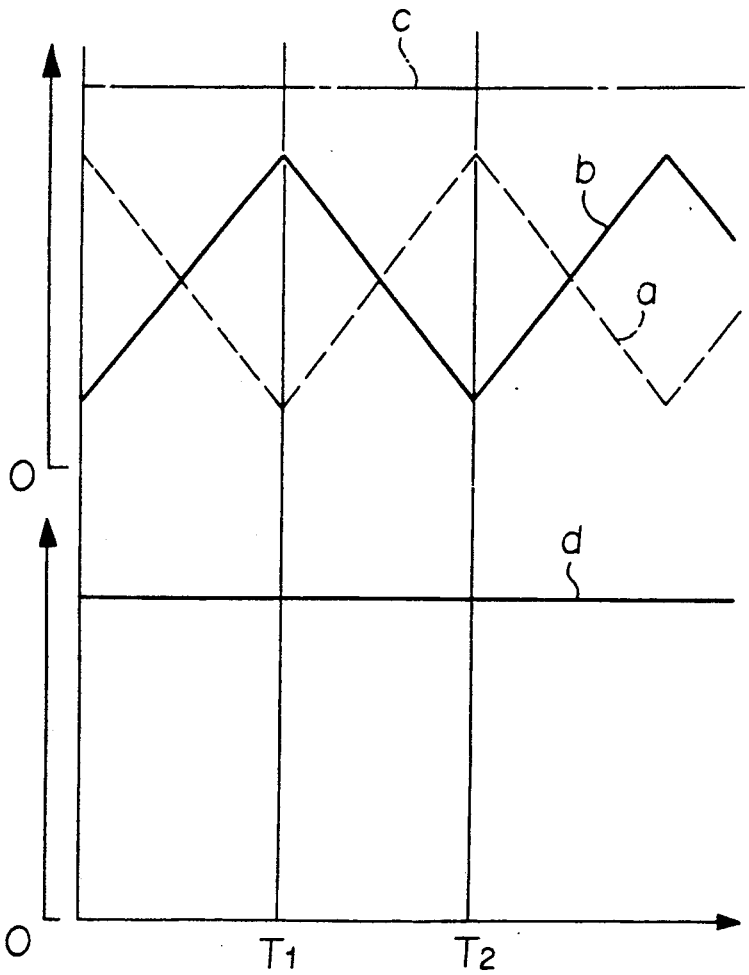
FIG. 14 is a schematic diagram showing the flowing state of the blowing air in the conventional apparatus.
Figure 15:
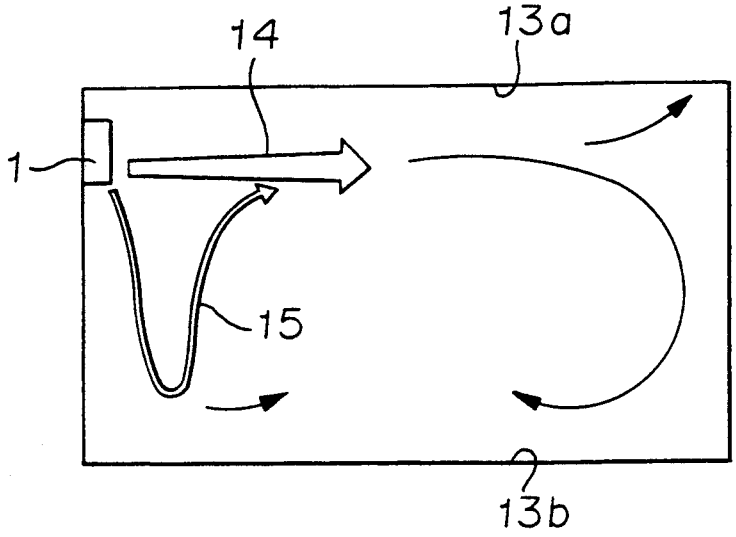
FIGS. 15 and 16 are schematic diagrams showing the flow of the blowing air.

Next, the temperature characteristics which is obtained when the second embodiment of the air conditioning apparatus according to the present invention carries out the room heating operation will be explained with reference to FIG. 9.

In the duration between the commencement $t_0$ of the room heating operation and a time $t_2$ when the heat exchanger temperature $T_{HEX}$ achieves the set temperature (e.g. 40° C.), the conditioned air can heat simultaneously the wall surface and the ceiling surface to minimize cold radiation and to increase warmness. At the time $t_2$, the blowing direction of the conditioned air is changed to the slant direction to make the floor surface temperature become at the same level as the room temperature, improving the temperature distribution in the room, and allowing a user to feel sufficiently warm. The ceiling surface and the wall surface are adversely not affected by cold radiation even after the time $t_2$ because the ceiling surface and the wall surface had sufficiently been heated between the time $t_0$ and the time $t_2$.

We claim:

1. An air conditioning apparatus for heating air in a space having an upper portion and a lower portion, the space being lined by a floor, a ceiling and at least one side wall at which the apparatus is positioned, the apparatus comprising:

a heat exchanger for exchanging heat with air of the space to form conditioned air, a plurality of outlet ports for issuing conditioned air to the space, a blowing fan for blowing conditioned air from the outlet ports to the space, an air directing plate arranged at at least one of the outlet ports to control flow from the plurality of outlet ports to one of the floor, and the upper and lower portions of the space, an operation state detecting means for detecting an operating state of the apparatus to determine a heating load of the apparatus, control means for determining the heating load from the detected operating state and for comparing the heating load with a reference value, and a driving means for adjusting the position of the air directing plate, depending on signals from the control means, wherein flow of conditioned air to the floor, and the upper and lower portions of the space is controlled by the comparison between the heating load of the apparatus and the reference value.

2. An air conditioning apparatus according to claim 1, wherein the heat exchanger is an variable capacity heat exchanger and the fan provides a constant volume of conditioned air.

3. An air conditioning apparatus according to claim 1, wherein the plurality of outlet ports include a horizontal outlet port positioned substantially in a horizontal direction and a lower outlet port for directing air to the lower portion of the space.

4. An air conditioning apparatus according to claim 3, wherein the horizontal outlet port has the air directing plate for directing conditioned air issued therefrom to one of the upper portion of the space and the floor.

5. An air conditioning apparatus according to claim 4, wherein the control means controls the air directing plate to be positioned so that conditioned air is provided mainly to the floor when the heating load of the apparatus is greater than the reference value and wherein the control means controls the air directing plate to be positioned so that conditioned air is provide to both the upper and lower portions of the space when the heating load of the apparatus is less than the reference value.

6. An air conditioning apparatus according to claim 5, wherein the operating state detecting means includes temperature detecting means for detecting a temperature of the heat exchanger and for detecting a temperature of a main body of the apparatus, wherein the control means determines the heating load of the apparatus from a difference between the detected temperature of the heat exchanger and the main body, and wherein the reference value is a preset temperature difference value.

7. An air conditioning apparatus according to claim 3, wherein the horizontal outlet port is provided with the air directing plate for directing conditioned air to at least one of the ceiling and the floor of the space and the lower outlet port is provided with another air directing plate for directing conditioned air to one of the side wall and the lower portion of the space.

8. An air conditioning apparatus according to claim 7, wherein the control means controls the air directing plates to be positioned so that conditioned air is directed to the floor when the heating load of the apparatus is greater than the reference value, and wherein the control means control the air directing plates to be positioned so that conditioned air is directed to the ceiling and side wall when the heating load is less than the reference value.

9. An air conditioning apparatus according to claim 8, wherein the operating state detecting means includes means for detecting the temperature of the heat exchanger and the reference value is a minimum temperature of the heat exchanger.

10. An air conditioning apparatus according to claim 9, wherein the operating state detecting means further includes a timer for determining a time period since a start of the apparatus.

11. An air conditioning apparatus according to claim 10, wherein the control means compares the time period from the timer with a preset reference time period if the heating load is less than the reference value and positions the air directing so as to direct conditioned air to the floor when the time period is greater than the preset time period.

12. An air conditioning apparatus according to claim 1, wherein the apparatus is a heater.

* * * * *